US005611716A

United States Patent [19]

Egenolf

[11] Patent Number: 5,611,716

[45] Date of Patent: Mar. 18, 1997

[54] ELECTRICAL CONTACT HAVING IMPROVED SECONDARY LOCKING SURFACES

[75] Inventor: Bernhard Egenolf, Dreieich, Germany

[73] Assignee: The Whitaker Corporation, Wilmington, Del.

[21] Appl. No.: 411,004

[22] Filed: Mar. 27, 1995

[30] Foreign Application Priority Data

Apr. 7, 1994 [GB] United Kingdom ..... 9406929

[51] Int. Cl.[6] ..... H01R 11/22

[52] U.S. Cl. ..... 439/857; 439/851; 439/752

[58] Field of Search ..... 439/842, 843, 439/851–857, 861, 839, 744, 745, 746, 733, 752

[56] References Cited

U.S. PATENT DOCUMENTS

| | | | |
|---|---|---|---|
| 4,159,160 | 6/1979 | Plyler et al. | 439/857 |
| 4,447,109 | 5/1984 | Hobart, Jr. | 439/851 |
| 4,707,050 | 11/1987 | Konneman | 439/851 |
| 4,813,881 | 3/1989 | Kirby | 439/79 |
| 4,938,720 | 7/1990 | Romak | 439/839 |
| 4,984,998 | 1/1991 | Duncan et al. | 439/752 |
| 5,334,058 | 8/1994 | Hotea | 439/851 |
| 5,478,263 | 12/1995 | Kato | 439/752 |

FOREIGN PATENT DOCUMENTS 2220310 4/1990 United Kingdom .

*Primary Examiner*—David L. Pirlot

[57] ABSTRACT

An electrical contact having a box like central portion from one end of which contact arms extend to electrically engaged a tab-type terminal. Extending from another end of the box like central portion is a transition section that interconnects the central portion with a conductor engaging portion. The central portion includes side walls having extensions that are inwardly folded to present improved bearing surfaces that, along with upwardly folded walls define first and second secondary lock areas. The bearing surfaces including sufficient surface area to assure reliable and maintainable secondary locking with the connector housing.

14 Claims, 2 Drawing Sheets

ELECTRICAL CONTACT HAVING IMPROVED SECONDARY LOCKING SURFACES

BACKGROUND OF THE INVENTION

1. Field of the Invention

The subject of this invention relates to an improved electrical contact, and more particularly to an electrical contact for use in high vibration environments where it is advantageous to provide secondary locking.

2. Description of the Prior Art

The are many applications for electrical connectors where the interconnection is subject to high vibrations, for example automotive electrical systems. Furthermore, it is desirable to minimize the size of the electrical contact to provide for a high density of electrical connections. As the size of the electrical contact is reduced, the magnitude of the mechanical forces that can be exerted at the electrical interconnection is also reduced. As a result, in high vibration environments, the magnitude of the mechanical force may not be sufficient to retain engagement between the electrical contact and the mating component to maintain the electrical interconnection.

One interconnection commonly used in high vibration environments is between a tab-type terminal and a socket-type electrical contact which is retained in a connector housing that is adapted to mate with the component containing the tab-type terminal. A known socket-type electrical contact includes two opposing contact arms that are constricted to engage the tab-type terminal therebetween and exert a normal force against the tab. The contact arms are interconnected to a central body that commonly formed into a box like member. A transition section extends from the central body opposite the contact arms to a conductor engaging portion that may be adapted to the crimpably attached to a conductor, such as an insulated wire.

In order to assure the interconnection of a socket-type electrical contact as described above, it is known to include a secondary locking feature that mechanically locks the electrical contact to the housing within which it is disposed. The secondary locking member is typically a non-conductive component which may, or may not, be integrally formed as part of the connector housing and includes a bearing surface, or an engaging surface, that blocks the contact to prevent displacement thereof. The contact must contain a complementary bearing surface that is engageable or abuttable by the secondary locking member so that movement of the contact may be opposed. It is known to include this bearing surface as windows within the box-like central member, as a notch formed within the transition section of the contact, or to use the back edges of the box.

A problem with all of these constructions is that the bearing surface of the contact engageable by the secondary locking member is limited to the thickness of the material from which the contact is formed. This thickness is constantly being reduced. Another problem is that these bearing surfaces typically have sharp edges from the stamping and forming processes that are typically used to manufacture the contact which could, as a result of the vibration, result in the degradation of the secondary locking member, which is typically plastic, sufficient to enable the displacement of the socket relative the tab. This displacement may ultimately lead to the failure of the electrical interconnection.

SUMMARY OF THE INVENTION

It is an object of this invention to provide an improved secondary locking bearing surface for an electrical contact.

The object of this invention has been accomplished by providing secondary locking bearing surfaces upon the electrical contact by folding over a portion of the contact structure.

DETAILED DESCRIPTION OF THE PREFERRED EMBODIMENT

Figure 1:
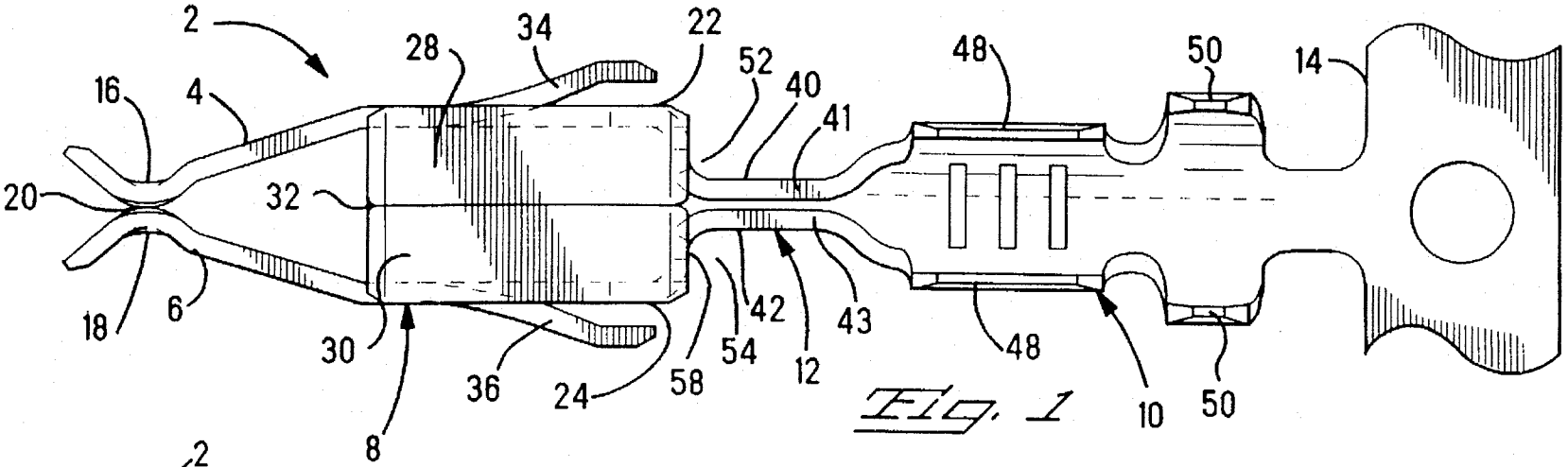
FIG. 1 is a top view of an embodiment of an electrical connector according to the present invention.

With reference first to FIG. 1, an electrical contact is shown generally at 2 that includes opposing contact arms 4,6 extending from a box like central portion 8 that is interconnected to a conductor engaging portion 10 by way of a transition section 12. The electrical contact 2 is shown attached to carrier strip 14 used during manufacturing process that will be severed therefrom before being inserted into the connector housing (not shown). The contact arms 4,6 are constricted at 16 and 18 respectively to form a receiving opening 20 for a tab-type terminal (not shown) so that the contact arms 4,6 will engage the tab-type terminal and exert a normal force thereupon.

Figure 2:
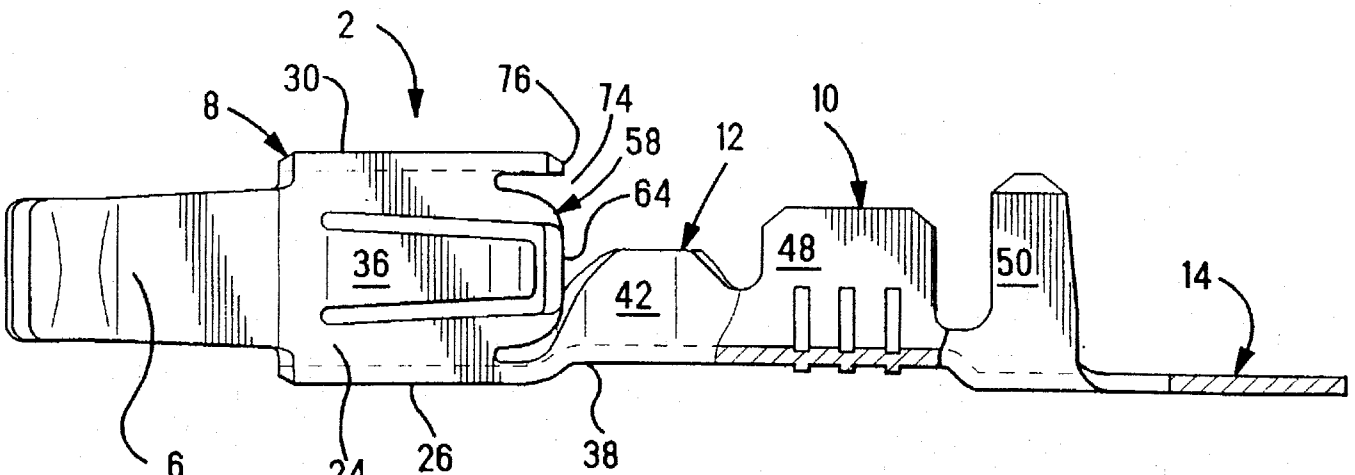
FIG. 2 is a side view of the electrical connector shown in FIG. 1.

With reference now to FIGS. 1 and 2, the box-like central portion 8 includes opposite side walls 22,24 separated by a base 26 and top halves 28 and 30 that are joined together along seam 32. These halves 28,30 can be joined by way of any of a number of known methods, such as welding or providing complementary engaging profiles to the halves 28,30 that form an interlocking seam. Locking lances 34,36 are folded out of side walls 22,24 respectively to retain the electrical contact 2 within the contact housing while still providing for some torsional flexibility.

The box-like central portion 8 is interconnected to the transition section 12 by way of tang 38 that extends from the base 26 of the box like central portion 8. The transition section 12 further includes oppositely facing upwardly folded walls 40,42 from the tang portion 38. These walls 40,42 include upper edges 44,46 respectively. The tang 38 further extends to the conductor engaging portion 10 which includes a pair of conductor crimp arms 48 which are crimpable upon an electrical conductor and a pair of strain relief crimp arms 50 which are crimpable to the insulation surrounding a common conductor to provide strain relief.

Returning to FIG. 1, it can be observed that the aforedescribed structure defines a first secondary locking area 52 and a second secondary lock area 54 on opposite sides of the transition section 12. The upwardly folded walls 40,42 form one boundary of the secondary locking areas 52,54 while the rear of the box like central portion 8 forms the other boundary. As can be readily observed in the Figure, by properly configuring the transition section 12, the electrical contact 2 can be made symmetrical so that the contact 2 may be inserted into the housing without regard as to whether the secondary locking member of the housing is to engage the first or second secondary locking areas 52,54.

Figure 3:
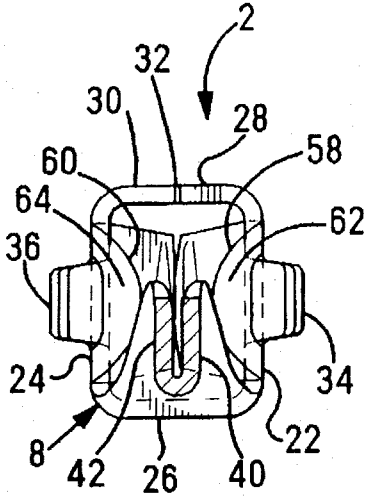
FIG. 3 is a view of the electrical contact taken along line 3—3 of FIG. 2.

With reference now to FIGS. 2 and 3, the rear 56 of the box-like central portion 8 includes inwardly folded extensions 58,60 of side walls 22,24 respectively. These extensions 58,60 are folded into the open portion of the box such that the side wall surfaces 22,24 wrap around the rear of the box-like central portion 8 to form bearing surfaces 62,64. These bearing surfaces 62,64 form the engagement surfaces of the first secondary lock area 52 and the second secondary lock area 54, thereby presenting the secondary lock member of the connector with bearing surfaces 62,64 that are sufficient in size and character to assure reliable locking.

Figure 4:
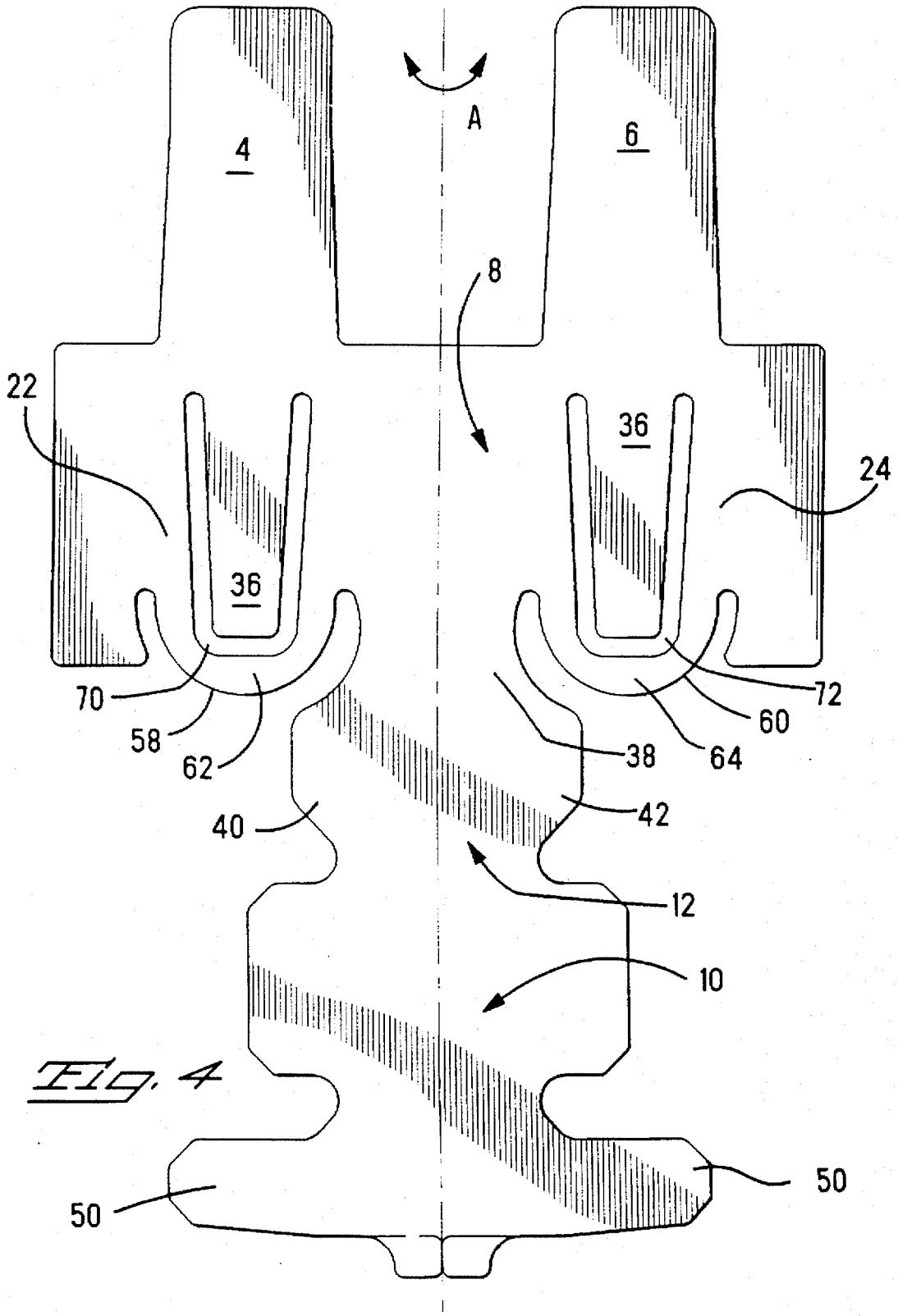
FIG. 4 is an unfolded view of the electrical connector of FIG. 1.

With reference now to FIG. 4, the electrical contact 2 is folded in the direction shown by arrow A. In the plan view of this Figure, the extensions 58,60 of the side walls 22,24 have an arcuate periphery that encompasses the free end 66,68 of the locking lances 34,36 respectively. When these extensions 58,60 are folded inward about openings 70,72 that define the locking lances 34,36, the bearing surfaces 62,64 face rearward to provide for engagement by the secondary locking member to retain the electrical contacts 2 within the connector housing.

As may also be observed in the Figures, it is possible to provide the contact 2 with a third secondary locking area 74, as best seen in FIG. 2, that is bounded by the bearing surfaces 62,64, possibly the end 76 of top halves 28,30, and the upper edges 40,42 of the upwardly folded walls 40,42. If desired, this third secondary locking area 74 would enable the contact to be inserted into the connector housing to electrically engage a tab-type terminal that is oriented 90° to the tab-type terminal that could be engaged when the first and second secondary locking areas 52,54 are utilized. If however it is desired to prevent utilization of this area 74, thereby assuring particular orientation of the contact 2, the upwardly folded walls 40,42 may be extended such that the secondary locking member may not be received in this area 74. Furthermore, while the bearing surfaces 62,64 are defined by bending extensions 58,60 through an angle of approximately 90°, other angles including 180° to form a bunt edge may also be utilized. Additionally, a two piece structure may be used where the central portion includes an outer box and the improved surfaces are formed thereupon.

I claim:

1. An electrical contact that is receivable in a connector housing for interconnection with a complementary terminal, the contact comprising:

contact arms to engage the complementary terminal;

a central portion of box-like structure having a base and opposing side walls which include a rearwardly and outwardly extended cantilevered locking lance that is defined by a U-shaped opening, the side walls further including a portion rearward of the locking lance, where the contact arms extend from a forward end of the central portions;

a conductor engaging portion for engaging an electrical conductor; and a transition section including upwardly folded side walls having an upper edge, where the transition section interconnects the central portion and the conductor engaging portion;

where the contact further includes three secondary locking areas selectively receiving a secondary locking member of the housing to retain the contact therein, the secondary locking areas including bearing surfaces formed by inwardly folding the portion of each side wall rearward of the U-shaped opening such that two areas are symmetrically disposed on opposite sides of the transition section and the third area is located above the upper edges of the upwardly folded walls of the transition section.

2. The electrical contact of claim 1, wherein the contact arms extend from the opposing side walls.

3. The electrical contact of claim 1, wherein the portion is inwardly folded at the base of the U-shaped opening.

4. The electrical contact of claim 1, wherein the portion includes a rear edge having a curved profile.

5. The electrical contact of claim 1, wherein the contact is formed from a single piece of material.

6. The electrical contact of claim 1, further comprising a cover opposite the base of the central portion.

7. The electrical contact of claim 6, wherein the cover extends rearward approximately equal to the bearing surface of the inwardly folded portions.

8. An electrical contact that is receivable in a connector housing for interconnection with a complementary terminal, the contact comprising:

contact arms to engage the complementary terminal;

a central portion of box-like structure having a base and opposing side walls which include a rearwardly and outwardly extended cantilevered locking lance that is defined by a U-shaped opening, the side walls further including a portion rearward of the locking lance, where the contact arms extend from a forward end of the central portions;

a conductor engaging portion for engaging an electrical conductor; and a transition section including upwardly folded side walls having an upper edge, where the transition section interconnects the central portion and the conductor engaging portion;

where the contact further includes a pair of secondary locking areas for selectively receiving a secondary locking member of the housing to retain the contact therein, the secondary locking areas including bearing surfaces formed by inwardly folding the portion of each side wall rearward of the U-shaped opening such that the two areas are symmetrically disposed on opposite sides of the transition section, where the upper edges of the sidewalls are disposed to prevent engagement by the secondary locking member thereabove.

9. The electrical contact of claim 8, wherein the contact arms extend from the opposing side walls.

10. The electrical contact of claim 8, wherein the portion is inwardly folded at the base of the U shaped opening.

11. The electrical contact of claim 8, wherein the portion includes a rear edge having a curved profile.

12. The electrical contact of claim 8, wherein the contact is formed from a single piece of material.

13. The electrical contact of claim 8, further comprising a cover opposite the base of the central portion.

14. The electrical contact of claim 13, wherein the cover extends rearward approximately equal to the bearing surface of the inwardly folded portions.

* * * * *